United States Patent [19]

Kowalczyk et al.

[11] Patent Number: 4,963,849

[45] Date of Patent: Oct. 16, 1990

[54] COMPACT CURRENT LIMITING CIRCUIT BREAKER

[75] Inventors: Karen B. Kowalczyk, New Britain; David Arnold, Chester; Roger N. Castonguay, Terryville; Yuet-Ying Yu, Danbury, all of Conn.

[73] Assignee: General Electric Company, New York, N.Y.

[21] Appl. No.: 344,936

[22] Filed: Apr. 28, 1989

[51] Int. Cl.[5] ..... H01H 9/30

[52] U.S. Cl. ..... 335/201; 336/234; 200/147 R

[58] Field of Search ..... 336/234, 210; 335/201; 200/147 R

[56] References Cited

U.S. PATENT DOCUMENTS 4,220,934 9/1980 Wafer et al. .
4,375,021 2/1983 Pardini et al. .
4,470,027 9/1984 Link et al. .
4,652,975 3/1987 Scott .
4,733,032 3/1988 Pardini .
4,754,247 6/1988 Raymont et al. .
4,789,848 12/1988 Castonguay et al. .
4,806,893 2/1989 Castonguay et al. .
4,827,237 5/1989 Blackburn ..... 336/234

FOREIGN PATENT DOCUMENTS 484501 2/1970 Switzerland .

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A compact circuit breaker utilizing an electronic trip unit for overcurrent determination contains a compact slot motor and a compact arc chute to minimize and control the arc that occurs when the circuit breaker contacts become separated upon intense overcurrent conditions.

16 Claims, 5 Drawing Sheets

COMPACT CURRENT LIMITING CIRCUIT BREAKER

BACKGROUND OF THE INVENTION

An integrated circuit protection unit is defined as a circuit breaker that includes optional accessory protection features. One such integrated circuit protection unit is described in U.S. Pat. No. 4,754,247 which Patent is incorporated herein for reference purposes. The Patent includes an accessory cover which is accessible for field-installation of selected accessory functions. The circuit breaker also includes an electronic trip unit in the form of a printed wire board positioned within a recess formed in the circuit breaker cover.

A current limiting circuit breaker utilizes the electromagnetic repulsion that occurs between the fixed and movable contact arms upon intense short circuit conditions to separate the circuit breaker contacts before the circuit breaker operating mechanism has time to respond. One example of a current limiting circuit breaker is described within U.S. Pat. No. 4,375,021 which Patent is incorporated herein for reference purposes. The arrangement of the slot motor to accelerate the movement of the movable contact arm allows the circuit to be interrupted in the early stages of the current wave form and hence limits the current to a reasonable value. The specially-designed arc chute in the aforementioned Patent rapidly quenches and extinguishes the arc that occurs during the rapid separation of the contacts. The complex design of both the slot motor and arc chute, however, do not readily allow for application within an automated circuit breaker assembly process.

An effective slot motor configuration for current limiting circuit breakers is described within U.S. Pat. No. 4,220,934 wherein the slot motor comprises a stack of U-shaped laminations of magnetic material fitted within a formed housing. The U-shaped laminations define a closed-ended and open-ended slot motor wherein the movable contact arm is driven toward the open end of the slot.

A further slot motor configuration is described within U.S. Pat. No. 4,470,027 wherein a plurality of U-shaped laminations are arranged on both the top and bottom portions of a support housing to form a so-called "closed" slot motor wherein the movable contact arm moves from the bottom closed end to the top closed end of the slot.

U.S. Pat. No. 4,733,032 describes an electric arc chute wherein the configuration of the arc plates and the composition of the arc chute support material are optimized to rapidly cool and extinguish the arc that occurs upon current limiting circuit interruption. This Patent is incorporated herein for reference purposes and should be reviewed for its description of the arc quenching properties of the specific plastic resin material used within the arc chute support.

When current limiting is attempted in certain lower-rated industrial molded case circuit breakers, problems occur due to the compact size limitations on the circuit breaker components and the circuit breaker enclosure, per se. It is difficult to contain the intense arc that is generated during the current limiting circuit interruption within the compact confines of the circuit breaker enclosure without causing damage to the enclosure. It is also difficult to quench and cool the arc because of the size restraints on the circuit breaker components within the enclosure since larger arc chute designs do not readily fit within the confines of the compact circuit breaker enclosure.

One purpose of the instant invention is to provide a compact circuit breaker having a slot motor configuration that is arranged within a compact circuit breaker enclosure for rapidly driving the movable contact arm to an open position upon severe overcurrent conditions without damaging the enclosure and is readily assembled by automated means. A further purpose of the invention is to provide an efficient arc chute arrangement that rapidly quenches the arc that occurs upon separation of the circuit breaker contacts and safely directs the resulting arc gases out of the circuit breaker enclosure.

SUMMARY OF THE INVENTION

A slot motor design and arc chute configuration provide current limiting in a circuit breaker containing an electronic trip unit that is contained within a common circuit breaker enclosure. The slot motor can be assembled in an off-line automatic process and includes integral means for preventing the movable contact arm from reclosing after electrodynamic repulsion. The arc chute can also be automatically assembled and includes an arc plate configuration which controls the intensity of the arc and the direction of effluent arc gases for rapid cooling and efficient extinction of the arc without damage to the circuit breaker enclosure.

DESCRIPTION OF THE PREFERRED EMBODIMENT

Figure 1:
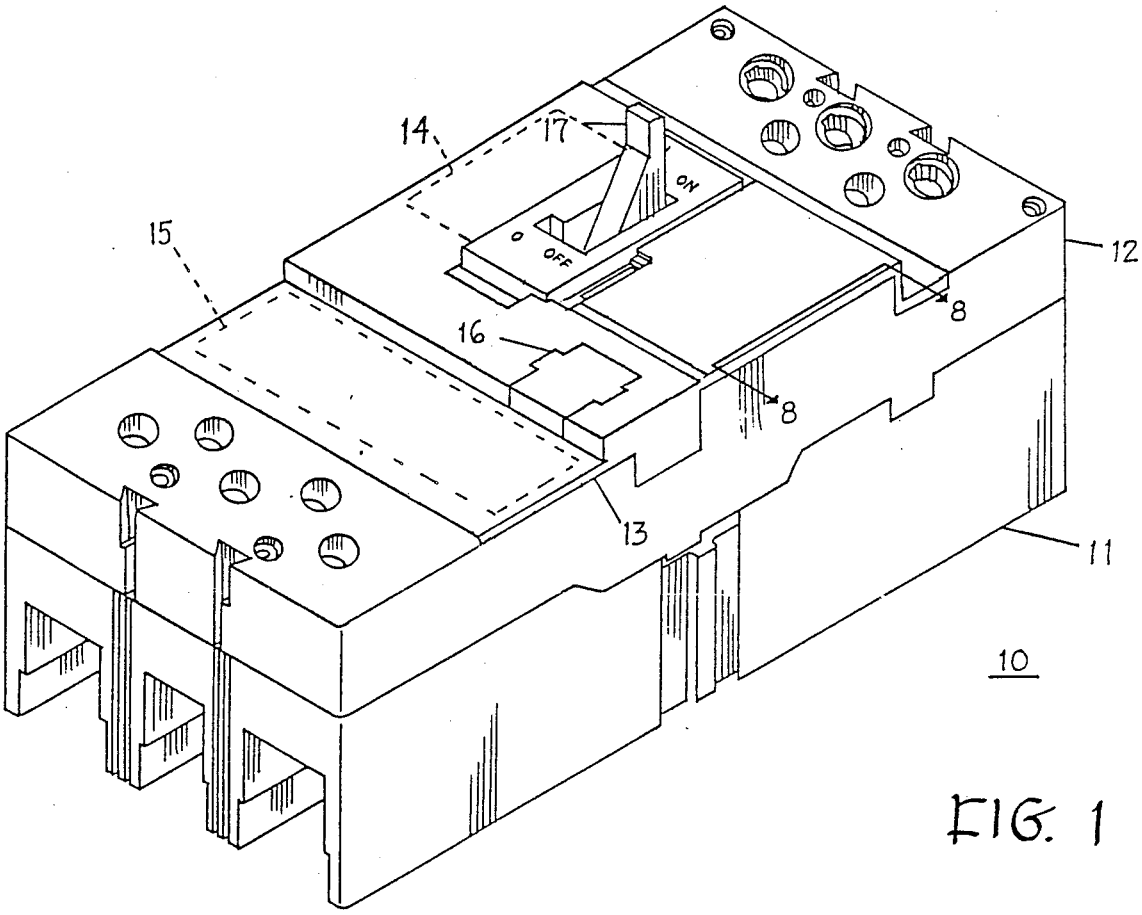
FIG. 1 is a top perspective view of a circuit breaker containing the slot motor design and arc chute configuration according to the invention.

An integrated circuit breaker 10 as shown in FIG. 1, consists of a case 11 to which a circuit breaker cover 12 is attached. The circuit breaker cover in turn is fitted with an accessory cover 13 for providing access to the trip actuator 14 and the trip unit 15 that are contained within the circuit breaker cover without interferring with the integrity of the circuit breaker operating components that are contained within the case 11. A rating plug 16 positioned within the accessory cover allows a standard-sized circuit breaker to be utilized over a wide range of ampere ratings by selecting the proper rating plug. The circuit breaker operating handle 17 allows for manual intervention for turning the circuit breaker contacts that are contained within the case to their ON and OFF positions.

Figure 2:
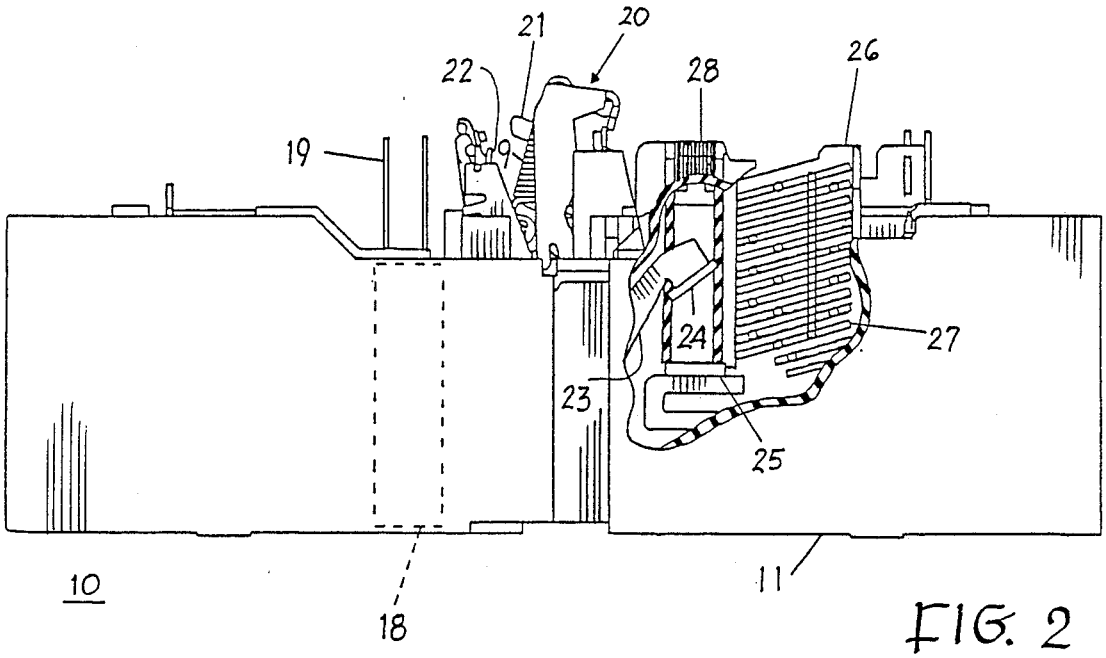
FIG. 2 is a side view of the circuit breaker depicted in FIG. 1 in partial section with the cover removed to show the configuration of the slot motor and the arc chute contained therein.

The circuit breaker 10 is depicted in FIG. 2 with the accessory cover, circuit breaker cover and part of the case 11 removed to show the interaction of the various components contained therein. The circuit current is sensed within three current transformers, one for each phase of the protected circuit, one of which is represented at 18 for purposes of this disclosure. The current transformers interconnect with the trip unit 15 shown earlier in FIG. 1, by means of upstanding circuit breaker pins 19 in the manner described within U.S. patent application Ser. No. 299,179 filed Jan. 18, 1989 and entitled "Molded Case Circuit Breaker Current Transformer Assembly", which Application is incorporated herein for purposes of reference. An alternate method of interconnecting the current transformers with the trip unit is described within U.S. Pat. No. 4,652,975.

The circuit breaker trip unit 15 of FIG. 1 interacts with the operating mechanism 20 by means of the trip actuator 14 also shown in FIG. 1. The trip actuator is described within U.S. Pat. No. 4,806,893, which Patent is incorporated herein for reference purposes and should be reviewed for the teachings contained therein. The operating mechanism is described within U.S. Pat. No. 4,789,848 and basically contains a cradle 21 and a latch 22 which restrains the powerful operating mechanism springs 9 from driving the movable contact arm 23 to the open position, depicted in FIG. 2 wherein the movable contact 24 is separated from the fixed contact 25 to interrupt the circuit current. The circuit current is also interrupted upon the occurrence of an intense short circuit condition whereby the movable contact arm becomes electrodynamically driven to its open position by operation of the slot motor 28. The current limiting aspect of the slot motor is described within the aforementioned U.S. Pat. No. 4,375,021. The intense arc that occurs when the contacts 24, 25 become separated under overcurrent conditions is controlled within the arc chute 26 wherein the arc contacts the plurality of metal arc plates 27 to become cooled and quenched to complete the circuit interruption process. As described earlier, the compact arrangement of the components within the circuit breaker case require an efficient slot motor of like compact configuration.

Figure 3:
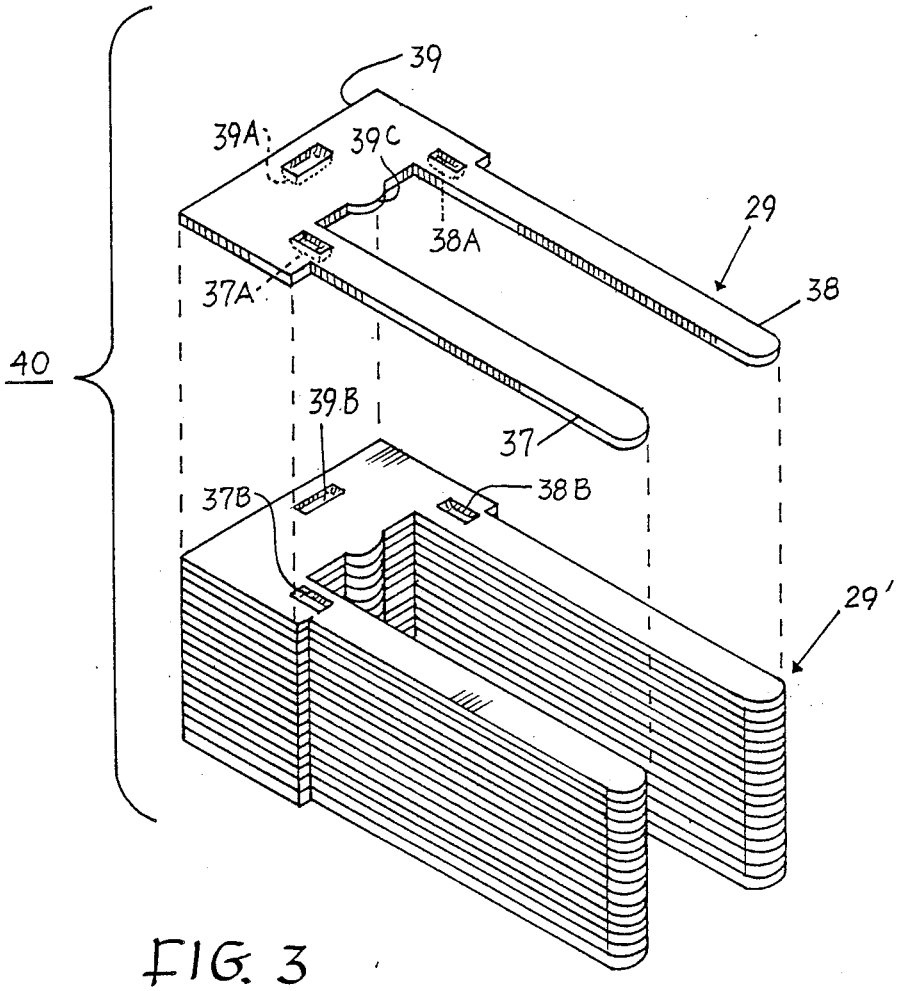
FIG. 3 is a top perspective view in isometric projection of the laminations used within the slot motor of FIG. 2.
Figure 5:
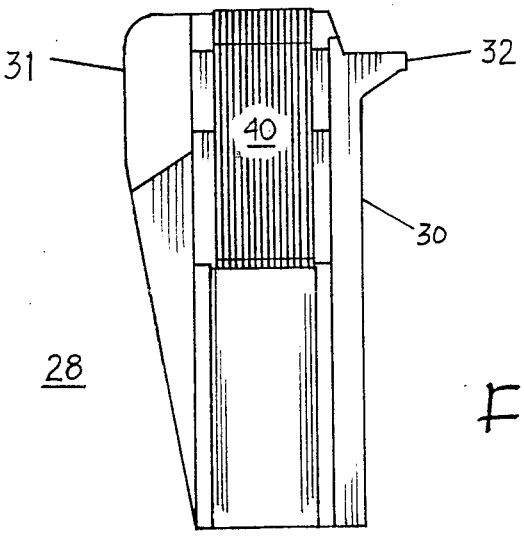
FIG. 5 is a side perspective view of the assembled slot motor depicted in FIG. 4.
Figure 4:
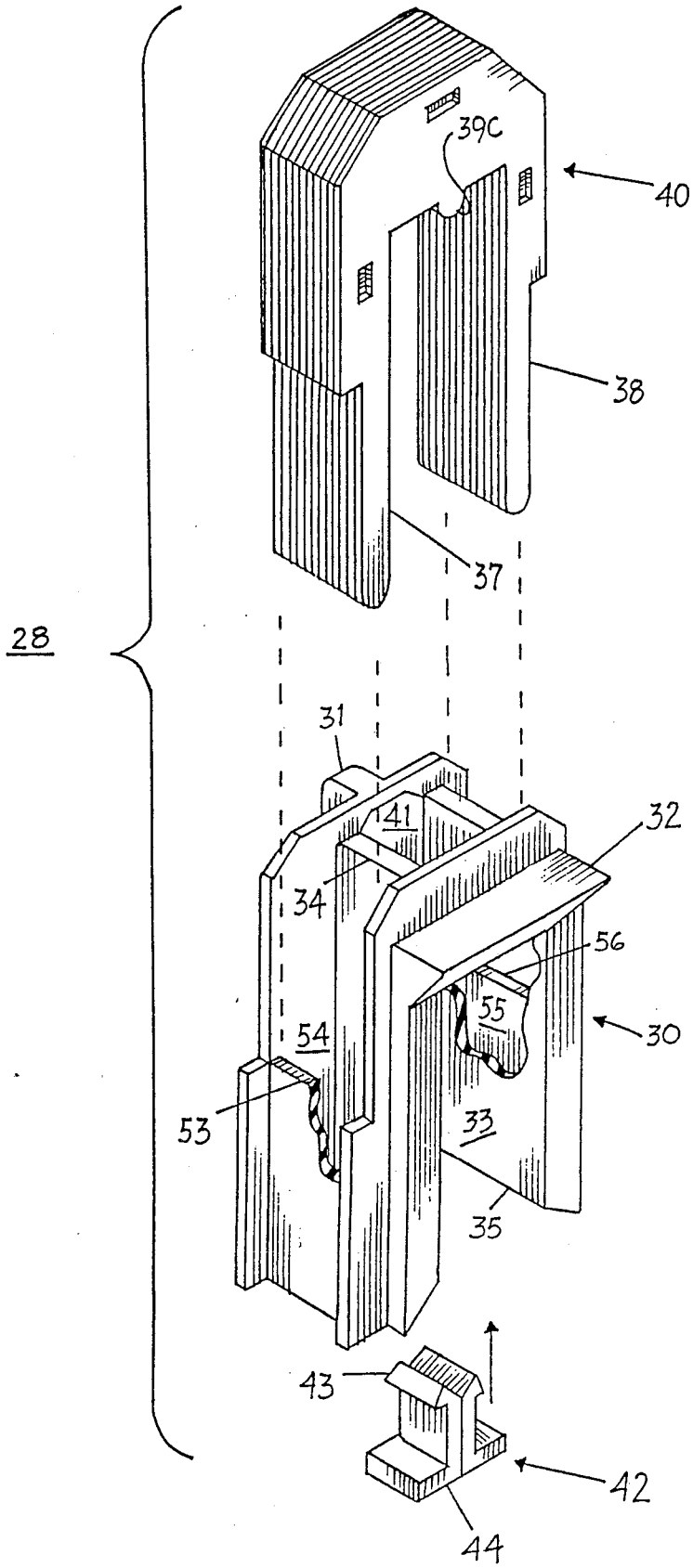
FIG. 4 is a top perspective view in isometric projection of the slot motor depicted in FIG. 2.

To assist in the automated assembly of the slot motor 28, the lamination stack 40 depicted in FIG. 3 is automatically assembled. Each lamination 29 consists of a U-shaped configuration of magnetic metal having a pair of legs 37, 38 joined by a bight portion 39. To exactly position each individual lamination with the stack, the laminations are formed by means of a metal punch whereby a plurality of projections designated 37A, 38A and 39A extend from one surface as depicted on lamination 29 while a corresponding plurality of recesses as depicted at 37B, 38B and 39B on lamination 29' are formed on each opposing surface of the laminations. When the lamination 29 is brought into contact with lamination 29', the corresponding projections align and fall within the corresponding recesses to rapidly and accuratly form the completed stack 40. The radial protrusion 39C formed on the bight 39 intermediate the legs 37, 38 accurately locates and positions the lamination stack 40 within the slot motor housing 30 by means of the corresponding angulated end 43 formed within the top of the bumper 42 as best seen by referring now to FIG. 4. The slot motor housing is fabricated from a flexible plastic material, such as nylon, to provide sufficient support strength to retain the lamination stack while allowing for a slight flex of the housing when the legs 37, 38 of the lamination stack 40 are received within the pockets 54, 55 formed between the interior walls 34, 35 and exterior half-walls 53, 56. When the lamination stack 40 is inserted within the slot motor housing 30 a bumper 42 formed from a single casting of an elastomeric material is inserted within the bottom of the slot 41 by means of the bifurcated and angulated end 43 which positions the planar end 44 at the top of the U-shaped opening 33 defined between the interior walls 34, 35. The planar end serves as a stop for the movable contact arm to thereby absorb the impact and prevent the movable contact arm from rebounding after becoming electrodynamically repulsed within the slot motor. The vertically extending ridge 31 formed on the back surface of the housing provides structural support and assists in positioning the slot motor within the circuit breaker case while the horizontal ledge 32 formed on the front surface thereof assists in directing the arc that occurs between the separated contacts into the arc chute. The function of the horizontal ledge 32 is best seen by referring back to FIG. 1 wherein the slot motor 28 abuts the arc chute 26. It is noted that the ledge overlaps the arc chute and effectively directs the arc within the arc chute thereby preventing the escape of the arc gases before such gases are cooled and de-ionized within the arc chute. The completely assembled slot motor 28 is depicted in FIG. 5 to show the orientation between the forward horizontal ledge 32 and rear vertical ridge 31 formed on the slot motor housing 30 as well as the arrangement of the lamination stack 40 therebetween.

Figure 7:
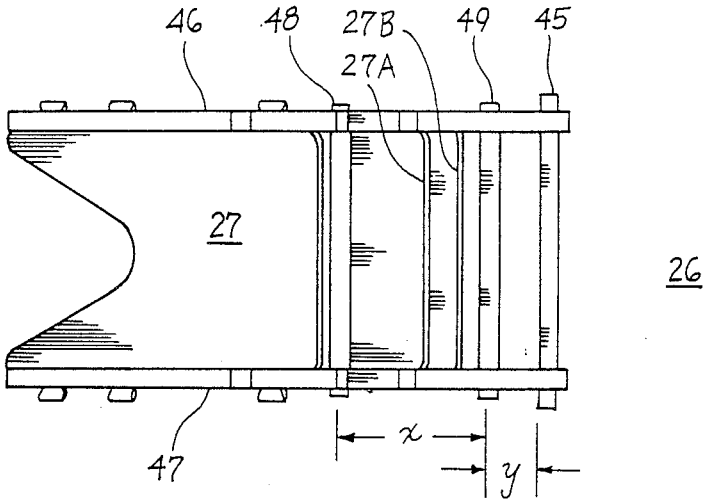
FIG. 7 is a plan view of the arc chute of FIG. 6.
Figure 6:
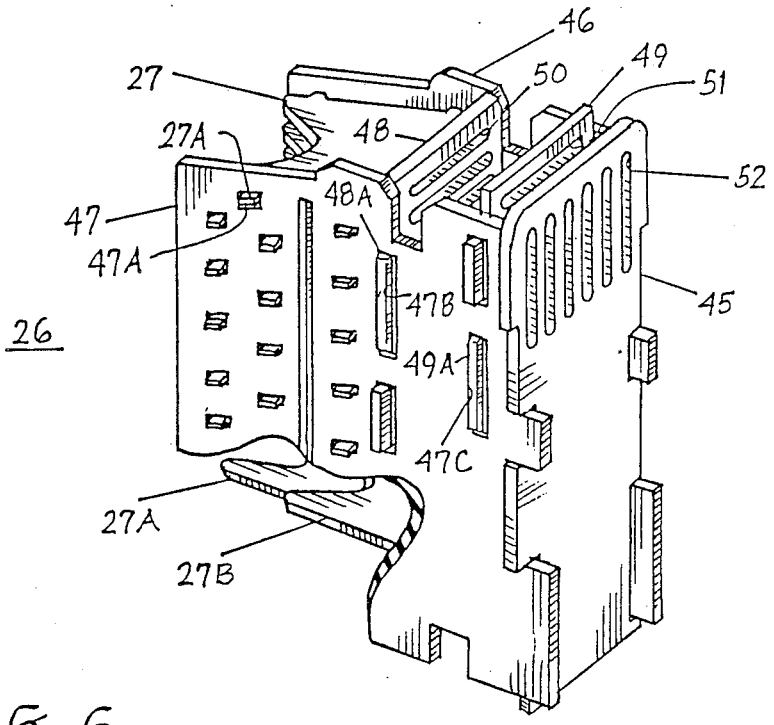
FIG. 6 is a top perspective view of the arc chute depicted in FIG. 2.

The arc chute 26 is depicted in FIGS. 6 and 7 to show the compact arrangement of the electrically insulative back plate 45 and the two adjoining side walls 46 and 47. The side walls support the arc plates 27 along with the forward and rear baffles 48 and 49. To automatically assemble the arc plates to the side walls, a projection 27A extends through a corresponding slot 47A formed in the side wall 47. Corresponding slots extend through the side wall 46, although not shown. The automatic assembly of the forward and rear baffle plates 48, 49 is faciliated by the provision of projections 48A and 49A on the sides of the baffle plates and corresponding slots 47B and 47C formed within the side plates 47. Similar projections and slots are formed on the opposite ends of the forward and rear baffle plates 48, 49. To rapidly direct the effluent arc gases away from the arc plates 27, the forward baffle plate is provided with a plurality of horizontal slots 50, the rear baffle plate 49 is provided with a plurality of horizontal slots 51 and the back plate 45 is provided with a corresponding plurality of vertically extending slots 52. To promote the rapid and efficient transfer of the arc that forms during contact separation, the two bottom-most arc plates 27A, 27B are off-set from the remaining arc plates and extend into the region defined between the forward baffle plate 48 and the rear baffle plate 49 depicted at x. The region defined between the rear baffle plate 49 and the back plate 45 is depicted at y.

Figure 8:
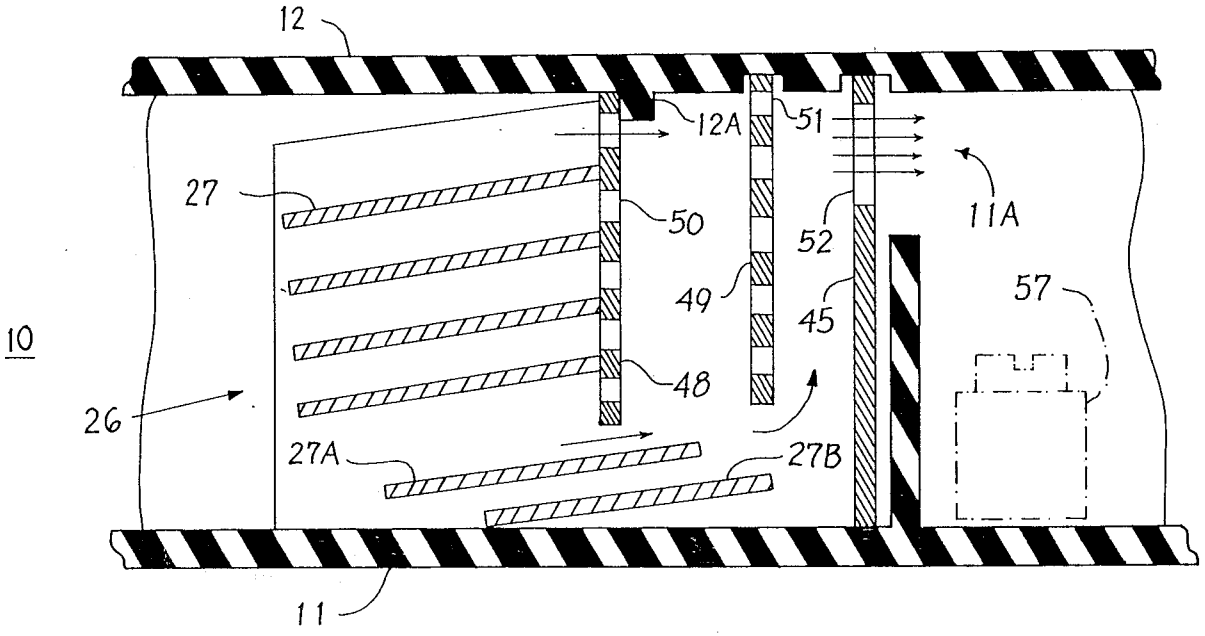
FIG. 8 is a cross-sectional side view of a part of the circuit breaker depicted in FIG. 2 viewed in the 8—8 plane.

The direction of the arc within the arc chute 26 and the direction of the arc gases throughout the arc chute is best seen by referring now to the circuit breaker 10 shown in partial section in FIG. 8. The arc chute 26 is arranged within the circuit breaker case 11 against the projection 12A within cover 12 such that a slot 11A is defined between the parting line of the circuit breaker case and cover to allow the egress of the arc gases out of the circuit breaker. The arc gases, as shown by the arrows, pass directly through the slots 50 formed in the forward baffle plate 48 and then through the slots 51 formed through the rear baffle plate 49. It is noted that the slots 51 are off-set from slots 50 at approximately the same angle $\alpha$ that the plates 27 are off-set from the horizontal plane defined by the circuit breaker case 11 and cover 12. This allows for a line-of-sight transfer of the arc gases between the forward and rear baffle plates and thereby optimizes the transfer of the gases through the slot 52 within the back plate 45 and from thence to the egress slot 11A described earlier. The off-set arc plates 27A, 27B promote the transfer of arc gases that exist near the bottom of the arc chute by directing the gas flow between the forward and rear baffle plates 48, 49 as well as between the rear baffle plate 49 and the back plate 45, as indicated. The slight off-set between slots 50, 51 provides for laminar flow in the region between the forward and rear baffle plates to thereby allow the arc gases to readily escape the arc plates 27 while promoting turbulent flow between the rear baffle plate and the back plate in order to deplete the kinetic energy of the gases prior to exiting the egress slot 11A. This is an important feature since energized circuit breaker terminal connectors 57 depicted in phantom are located beneath the egress slot 11A and it is essential to keep the ionized gases from contacting the line terminal connectors.

It has been determined that the distance x between the forward baffle plate 48 and rear baffle plate 49 should be approximately three times the distance y between the rear baffle plate 49 and the back plate 45 to insure that the effluent gases leaving the circuit breaker are sufficiently cool and de-ionized in order to prevent electrical interaction between the effluent arc gases and the line terminal connectors.

A compact current limiting circuit interrupter has herein been described wherein the slot motor is optimized for automated assembly and efficient operation. The arc chute configuration described herein is arranged for automated assembly and is designed to rapidly cool and de-ionize the arc that exists upon contact separation such that the effluent arc gases leaving the circuit breaker present no exterior electrical problems.

Having thus described our invention, what we claim as new and desire to secure by Letters Patent is:

1. A current limiting circuit breaker comprising:

a molded plastic case and cover arranged in a predetermined plane;

a pair of separable contacts within said case controlled by an operating mechanism;

a movable contact arm supporting one of said contacts and arranged for driving said one contact to an open position upon the occurrence of a short-circuit condition through said separable contacts;

an electronic trip circuit within said cover and arranged for articulating said operating mechanism upon occurrence of overcurrent conditions through said separable contacts longer than predetermined time periods to cause said movable contact and said one contact to move to their open positions;

a magnetic drive device arranged about said movable contact arm and consisting of a stack of U-shaped magnetic laminations having means integrally-formed therein for automatically aligning each of said laminations within said stack, said aligning means comprising a plurality of projections on one surface of each of said laminations and a corresponding plurality of depressions on an opposite surface thereof whereby one of said projections on one of said laminations is received within one of said depressions on another of said laminations;

a plastic support comprising a U-shaped member having a pair of depending legs joined by a bight and including a pocket formed outboard each of said support legs flexibly retaining said laminations on said support, said laminations comprising a pair of planar legs joined by a planar bight; and an arc chute arranged proximate said magnetic drive device for receiving an arc generated when said contacts become separated and cooling and extinguishing said arc to completely interrupt circuit current through said contacts.

2. The current limiting circuit breaker of claim 1 wherein one of said depressions is formed within said bight, and one of said depressions is formed within each of said legs.

3. The current limiting circuit breaker of claim 2 wherein said bight includes a planar projection integrally-formed therein, said planar projection being received within a slot formed within a top part of said support.

4. The current limiting circuit breaker of claim 3 wherein said bight further includes a ledge integrally-formed therein overlapping a part of said arc chute to thereby assist in directing said arc into said arc chute.

5. The current limiting circuit breaker of claim 1 wherein said arc chute comprises a pair of opposing electrically insulating side plates joined by a stack of electrically conducting arc plates, a bottom-most pair of said arc plates being offset from said stack to further assist in directing said arc into said arc chute.

6. The current limiting circuit breaker of claim 5 wherein said arc chute further comprises an electrically insulating forward baffle, a rear baffle and an end plate supported intermediate said side plates.

7. The current limiting circuit breaker of claim 6 wherein said forward and rear baffles are separated from each other by a first distance and said rear baffle is separated from said end plate by a second distance, said first distance being greater than said second distance.

8. The current limiting circuit breaker of claim 7 wherein said forward and rear baffles each comprise a rectangle having first and second sides said first sides being longer than said second sides, each of said forward and rear baffles including a plurality of spaced slots runing parallel with said second sides to promote laminar flow of arc gases between said forward and said rear baffles.

9. The current limiting circuit breaker of claim 8 wherein said end plate comprises a rectangle having a first side and a second side, said first side being longer than said second side, said end plate including a plurality of spaced slots running parallel with said second side to thereby promote turbulent flow of said arc gases between said rear baffle and said end plate.

10. The current limiting circuit breaker of claim 6 wherein said arc plates include projections formed therein and wherein said side plates include slots formed therein for receiving said projections to thereby attach said arc plates to said side plates.

11. The current limiting circuit breaker of claim 6 wherein said forward and rear baffles include projections formed therein and wherein said side plates include additional slots formed therein for receiving said projections to thereby attach said forward and rear baffles to said side plates.

12. The current limiting circuit breaker of claim 11 wherein said side plates each comprise projections extending from one end and said back plate includes slots formed therein for receiving said projections to thereby attach said back plate to said side plates.

13. The current limiting circuit breaker of claim 7 wherein said first distance is three times said second distance.

14. The current limiting circuit breaker of claim 9 wherein said rear baffle slots are offset from said forward baffle slots.

15. The current limiting circuit breaker of claim 14 wherein said arc plates are arranged in a stack, each of said arc plates being positioned at an inclined angle relative to said predetermined plane.

16. The current limiting circuit breaker of claim 15 wherein said rear baffle slots are arranged at said inclined angle to said forward baffle slots.

* * * * *